US008448732B2

(12) United States Patent
Sakane

(10) Patent No.: US 8,448,732 B2
(45) Date of Patent: May 28, 2013

(54) VEHICLE DRIVING APPARATUS

(75) Inventor: Masamichi Sakane, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 596 days.

(21) Appl. No.: 12/672,313

(22) PCT Filed: Sep. 10, 2007

(86) PCT No.: PCT/JP2007/067607
§ 371 (c)(1),
(2), (4) Date: Feb. 5, 2010

(87) PCT Pub. No.: WO2009/034607
PCT Pub. Date: Mar. 19, 2009

(65) Prior Publication Data

US 2011/0315460 A1 Dec. 29, 2011

(51) Int. Cl.
*B60K 1/00* (2006.01)

(52) U.S. Cl.
USPC ..... 180/68.1; 180/311

(58) Field of Classification Search
USPC ..... 180/65.1, 68.1, 68.2, 311, 312; 105/34.1, 105/35, 49, 96, 133; 305/8
See application file for complete search history.

(56) References Cited

U.S. PATENT DOCUMENTS 1,481,888 A 1/1924 Candee
4,348,604 A * 9/1982 Thode ..... 310/62
4,908,538 A * 3/1990 Geberth, Jr. ..... 310/59
5,450,798 A * 9/1995 Trenary ..... 105/155
5,735,215 A 4/1998 Tegeler
5,789,833 A 8/1998 Kinoshita et al.
6,700,235 B1 * 3/2004 McAfee ..... 310/52
7,644,792 B2 * 1/2010 Telakowski ..... 180/68.1

(Continued)

FOREIGN PATENT DOCUMENTS

DE 101 18 219 10/2002
JP 54-167904 11/1979

(Continued)

OTHER PUBLICATIONS

Supplementary European Search Report dated Sep. 24, 2010, issued in the corresponding European Patent Application No. 07849898.7-1268.

(Continued)

*Primary Examiner* — John Walters
*Assistant Examiner* — Brian Swenson
(74) *Attorney, Agent, or Firm* — Buchanan Ingersoll & Rooney PC

(57) ABSTRACT

In a vehicle in which side covers are disposed at the underfloor sides of a vehicle body, a totally enclosed main motor is disposed outside a frame of a chassis. The totally enclosed main motor includes an outside air ventilating flue through which the outside air is suctioned from a suction inlet, circulated and then exhausted from an exhaust outlet. The totally enclosed main motor uses the outside air ventilating flue to release heat generated internally to the outside. One end of a ventilating duct is connected to the suction inlet and the other end opens toward the outside of the vehicle at the side covers. With this, it is possible to supply the outside air from the outside of the vehicle thereby enhancing the cooling efficiency. Moreover, it is possible to use the totally enclosed main motor of a high capacity by disposing outside the frame of the chassis.

10 Claims, 6 Drawing Sheets

U.S. PATENT DOCUMENTS

| | | | | |
|---|---|---|---|---|
| 7,701,096 | B2 * | 4/2010 | Noda et al. | 310/57 |
| 8,006,626 | B2 * | 8/2011 | Kumar et al. | 105/49 |
| 8,097,070 | B2 * | 1/2012 | Le Flem | 95/270 |
| 2007/0273220 | A1 * | 11/2007 | Koyama et al. | 310/58 |
| 2009/0173471 | A1 * | 7/2009 | Sakamoto | 165/41 |

FOREIGN PATENT DOCUMENTS

| | | | |
|---|---|---|---|
| JP | 58-129194 | A | 8/1983 |
| JP | 61-064567 | A | 4/1986 |
| JP | 61-115767 | A | 6/1986 |
| JP | 5-229430 | A | 9/1993 |
| JP | 6-239229 | A | 8/1994 |
| JP | 7-089438 | A | 4/1995 |
| JP | 8-192654 | A | 7/1996 |
| JP | 9-219904 | A | 8/1997 |
| JP | 10-503145 | A | 3/1998 |
| JP | 10-157617 | A | 6/1998 |
| JP | 2000-158938 | A | 6/2000 |
| JP | 2003-048533 | A | 2/2003 |
| JP | 2003-088045 | A | 3/2003 |
| JP | 2004-194407 | A | 7/2004 |
| JP | 2005-271646 | A | 10/2005 |
| WO | WO 96/37397 | A1 | 11/1996 |

OTHER PUBLICATIONS

International Search Report of Application No. PCT/JP2007/067607 dated Nov. 20, 2007.

Non-English version of Written Opinion of the International Searching Authority of Application No. PCT/JP2007/067607 dated Nov. 20, 2007.

* cited by examiner

VEHICLE DRIVING APPARATUS

TECHNICAL FIELD

The present invention relates to a vehicle driving apparatus that drives a vehicle of an electric train or the like, and particularly relates to a vehicle driving apparatus that uses a totally enclosed electric motor.

BACKGROUND ART

A vehicle driving apparatus for driving a vehicle of an electric train or the like uses, as a driving source, an electric motor that is disposed under the floor of the vehicle body and runs the vehicle by transferring the torque of the electric motor to the wheels of the vehicle via gear devices and axles disposed on a chassis. With the increase in the running speed of vehicles, there is a demand for further reduction in the size and weight as well as further increase in the capacity of electric motors.

Conventionally, as an electric motor of this kind, an open type electric motor is disposed in which outside air is drawn in and used as cooling wind. Since outside air containing dust is drawn in an open type electric motor, it is necessary to perform maintenance tasks, such as replacement of filters for preventing taint damage to the electric motor and disassembling of the electric motor for periodical cleaning of internal parts, specific to the open type structure. Meanwhile, with the aim of enhancing comfort, there is a demand for noise reduction in the vehicular environment; and noise reduction of electric motors is an issue of particular concern among the issues regarding open type electric motors.

Thus, in response to the pursuit of less maintenance and the measures for reducing internal and external vehicular noise, totally enclosed electric motors have been developed. Because of its structure, the heat releasing capacity of a totally enclosed electric motor is substantially low as compared to an open type electric motor. Therefore, it is necessary to enhance the cooling efficiency. As an example of a cooling system for a totally enclosed electric motor, an outside air ventilating flue is disposed in the electric motor in isolation with the inside of the electric motor. Then, the outside air is ventilated through the outside air ventilating flue. Because of that, heat exchange occurs between the sealed air circulating inside the electric motor and the outside air flowing through the outside air ventilating flue. As a result, the heat generated inside the electric motor is released to the outside (e.g., see Patent Literature 1).

Patent Literature 1: Japanese Patent Application Laid-open No. 2004-194407

Patent Literature 1: Japanese Patent Application Laid-open No. S58-129194

DISCLOSURE OF INVENTION

Problem to be Solved by the Invention

However, following problems are found in a vehicle driving apparatus that uses a conventional totally enclosed electric motor.

In recent times, from the perspective of external aesthetics or with the aim of reducing travel resistance of train vehicles, it is common practice to dispose side covers at the underfloor sides of a vehicle body. If a totally enclosed electric motor is disposed under the floor of a vehicle having the side covers, then the air that has its temperature increased due to the heat release of the electric motor stagnates in the region surrounded by the side covers. Consequently, the high temperature air gets re-guided to the outside air ventilating flue as the cooling wind. This causes a substantial degradation in the cooling efficiency of the electric motor. As described above, the cooling efficiency in a totally enclosed electric motor is originally low as compared to an open type structure. Besides, attachment of the side covers to the vehicle causes further degradation in the cooling efficiency.

Conventionally, a vehicle driving electric motor is attached to a chassis that is disposed in the bottom part of a vehicle body. Because of that, the dimensions of the electric motor are constrained by the range of a standard rail width. This forces restriction on increasing the capacity of the electric motor. Particularly, in the case of a totally enclosed electric motor, it is necessary to additionally provide a cooling mechanism to enhance the cooling capacity. As a result, the size of a totally enclosed electric motor increases as compared to an open type electric motor capable of giving identical performance. This makes it difficult to install a high-capacity totally enclosed electric motor in a vehicle. Thus, if the required capacity is high, then sometimes the task of installing a totally enclosed electric motor on a chassis itself is not viable.

The present invention has been made to solve the above problems in the conventional technology and it is an object of the present invention to provide a vehicle driving apparatus that enables achieving enhancement in the cooling efficiency and enables installation of a high-capacity totally enclosed electric motor.

Means for Solving Problem

In order to solve the above mentioned problem and achieve the object, a vehicle driving apparatus according to the present invention that is disposed in a vehicle having a side cover at an underfloor side of a vehicle body and that runs the vehicle, with an electric motor as a power source, by rotatively driving an axle disposed on a chassis of the vehicle and a wheel fixed to the axle, the vehicle driving apparatus includes a totally enclosed electric motor that is disposed outside a frame of the chassis placed under a floor of the vehicle body, that includes an outside air ventilating flue through which outside air is suctioned from a suction inlet, circulated and exhausted from an exhaust outlet, and that uses the outside air ventilating flue to release heat generated internally to outside; a shaft that transmits a rotary drive force of the totally enclosed electric motor to the axle; and a ventilating duct that connects between the suction inlet and an opening formed on the side cover.

Effect of the Invention

According to an aspect of the present invention, a ventilating duct is disposed to connect a suction inlet of a totally enclosed electric motor to an opening formed on a side cover. Therefore, it becomes possible to supply the outside air from the outside of the vehicle as cooling wind to the totally enclosed electric motor. This eliminates the possibility of a conventional problem in which high temperature air affected by the exhaust heat around the totally enclosed electric motor is supplied. As a result, the cooling efficiency of the totally enclosed electric motor can be constantly maintained at a high level.

According to another aspect of the present invention, the cooling wind from the outside of the vehicle is supplied via the ventilating duct with the use of an air suction feature of an outside air ventilating flue that is disposed in the totally enclosed electric motor. This eliminates the need of newly disposing a device for producing a forced draft. Moreover, unlike in the conventional technology, the vehicle running wind generated when the vehicle is running is not used. Thus, even if it is not possible to obtain sufficient vehicle running wind when the vehicle slows down or when the electric motor is operating after the vehicle comes to a halt, it is still possible to maintain a high cooling efficiency.

According to still another aspect of the present invention, the totally enclosed electric motor is disposed outside the frame of a chassis. This eliminates the dimensional constraints regulated by the chassis while installing the totally enclosed electric motor. Thus, it becomes possible to dispose a high-capacity the totally enclosed electric motor. That is, by loading the totally enclosed electric motor to the vehicle body portion other than the chassis, it becomes possible to secure sufficient space and thus increase the capacity of the totally enclosed electric motor.

Moreover, since the totally enclosed electric motor is disposed outside the frame of the chassis, a shaft is disposed to connect the totally enclosed electric motor to an axle. In addition to its primary function of transmitting the rotary drive force of the totally enclosed electric motor to the axle, the shaft has good heat conductivity because of its metallic material. Thus, by helping the heat to release from the totally enclosed electric motor, the shaft contributes to the cooling effect. This enables achieving further enhancement in the cooling efficiency of the totally enclosed electric motor.

In this way, according to an aspect of the present invention, in addition to achieving the conventional advantages, such as less maintenance and low vehicular noise, of a totally enclosed electric motor; it is possible to provide a vehicle driving apparatus that includes a totally enclosed electric motor that has a high capacity as well as enhanced cooling efficiency.

EXPLANATIONS OF LETTERS OR NUMERALS

Figure 1:
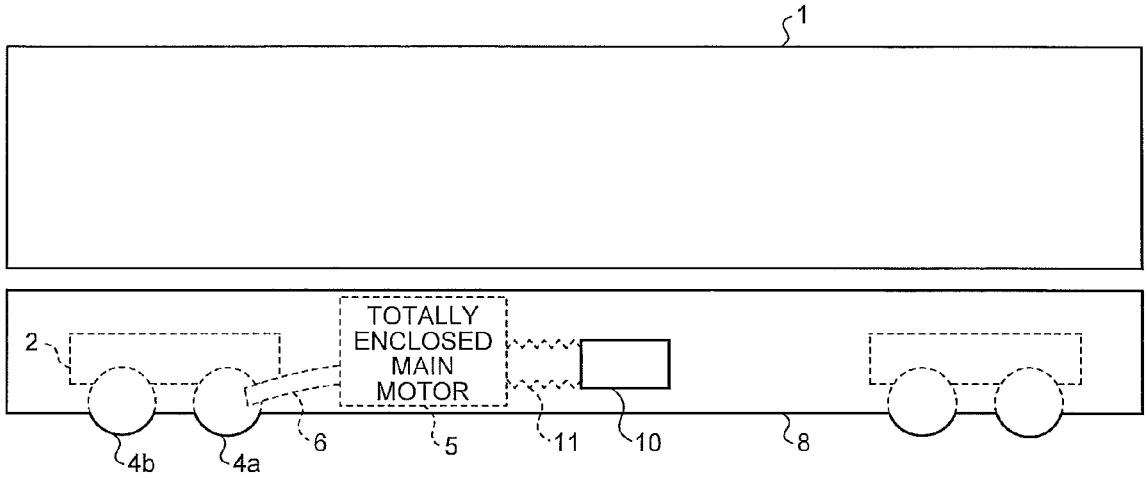
FIG. 1 is a schematic side view illustrating a configuration of a vehicle driving apparatus according to a first embodiment.

1 vehicle body
2 chassis
3*a*, 3*b* axle
4*a*, 4*b* wheel
5 totally enclosed main motor
6 shaft
8 side cover
9 ventilating duct
10, 18*a*, 18*b*, 31 opening
11 connecting portion
12 joint portion
13, 14 gear
17, 20*a*, 20*b* dust collecting filter
19 ventilating duct
30 ventilating duct
51 stator
52 stator winding
53 rotor
54 inside air ventilating flue
55 outside air ventilating flue
56 inner fan
57 outer fan
58 suction inlet
59 exhaust outlet
101*a*, 101*b* main motor
102*a*, 102*b* gear device
103*a*, 103*b* gear-type flexible coupling
104 chassis frame
105*a*, 105*b* axle
106 wheel

BEST MODE(S) FOR CARRYING OUT THE INVENTION

Exemplary embodiments for a vehicle driving apparatus according to the present invention will be described below in detail with reference to the accompanying drawings. The present invention is not limited to the embodiments described below.

First Embodiment

Figure 2:
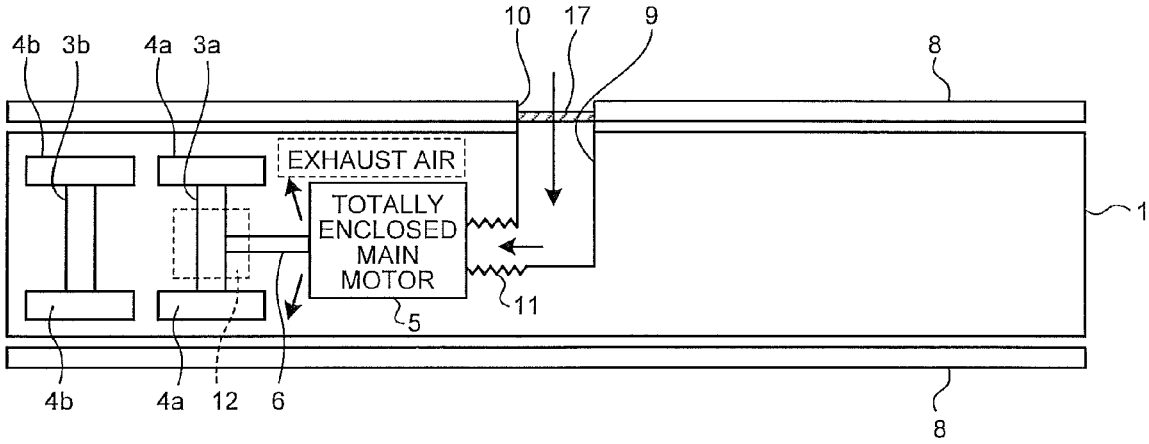
FIG. 2 is a schematic plan view illustrating the configuration of the vehicle driving apparatus according to the first embodiment when the bottom part of the corresponding vehicle is viewed from below.

FIG. 1 is a schematic side view illustrating a configuration of a vehicle driving apparatus according to the present embodiment. FIG. 2 is a schematic plan view illustrating the configuration of the vehicle driving apparatus according to the present embodiment when the bottom part of the corresponding vehicle is viewed from below. The vehicle driving apparatus according to the present embodiment is disposed in a train vehicle or the like, and runs the corresponding vehicle by converting electric power into torque with the use of an electric motor of a totally enclosed type electric motor (hereinafter referred to as a totally enclosed electric motor).

In the bottom part of a vehicle body 1, which is the main part of the train vehicle, are disposed chassis 2. On each chassis 2 are disposed axles 3*a* and 3*b*. A wheel 4*a* is impactedly fixed to each end of the axle 3*a*, while a wheel 4*b* is impactedly fixed to each end of the axle 3*b*. In the example illustrated in FIG. 1, two chassis 2 are disposed in a single vehicle and each chassis 2 has two axles. However, in FIG. 2, the chassis 2 are omitted for simplicity. Moreover, the axles and the wheels disposed on only one chassis are illustrated in FIG. 2. That is, the axles and the wheels disposed on the other chassis are omitted for simplicity.

From the perspective of aesthetics or with the aim of protecting the equipments and reducing travel resistance, side covers 8 are disposed at the underfloor sides of the vehicle body 1. The side covers 8 are, for example, skirts or the like and are disposed at both the underfloor sides of the vehicle body 1.

Outside the frame of the chassis 2, which are placed in the bottom part of the vehicle body 1, is disposed a totally enclosed main motor 5. In the present embodiment, disposing the totally enclosed main motor 5 outside the frame of the chassis 2 allows a higher degree of freedom with respect to the installation space. Thus, it is possible to dispose the totally enclosed main motor 5 of a high capacity. Meanwhile, comparison with an installation example of conventional main motors is given later in detail. The totally enclosed main motor 5 is installed under the floor by, for example, suspending it using a suspending device.

Figure 3:
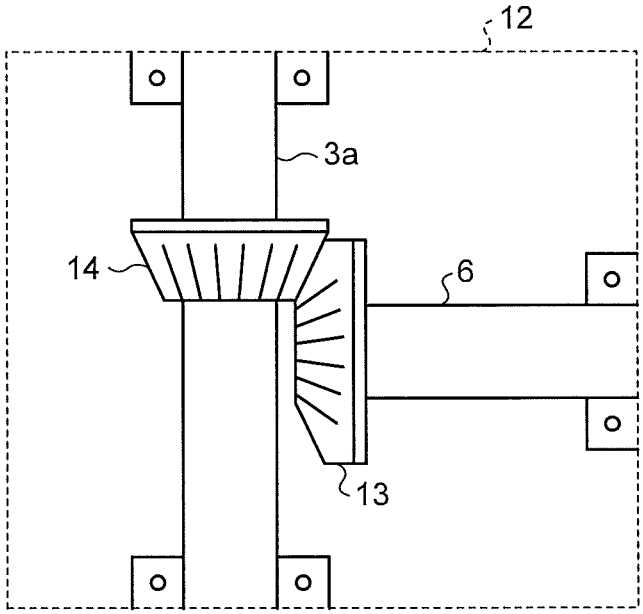
FIG. 3 is a detail view illustrating a joint portion between an axle and a shaft illustrated in FIG. 1.

A shaft 6 that transmits the rotary drive force to the axle 3*a* is attached at one end to the totally enclosed main motor 5 and is connected at the other end to the axle 3*a*. FIG. 3 is a detail view illustrating a joint portion 12 between the axle 3*a* and the shaft 6. As illustrated in FIG. 3, a rectangle cardan system is used as an exemplary connecting method in the present embodiment. That is, the shaft 6 and the axle 3*a* are placed orthogonal to one another, and a gear 13 attached to the tip of the shaft 6 engages with a gear 14 attached in the central portion along the longitudinal direction of the axle 3*a*. With this, the rotations of the shaft 6 are transformed into the rotations of the axle 3*a*. In the present embodiment, the drive force of the totally enclosed main motor 5 is directly transmitted only to the axle 3*a*, which is disposed at the near side of the totally enclosed main motor 5 than the axle 3*b*. That is, in the present embodiment, the totally enclosed main motor 5 is coupled with only one of the two axles that are attached to the same chassis.

Figure 4:
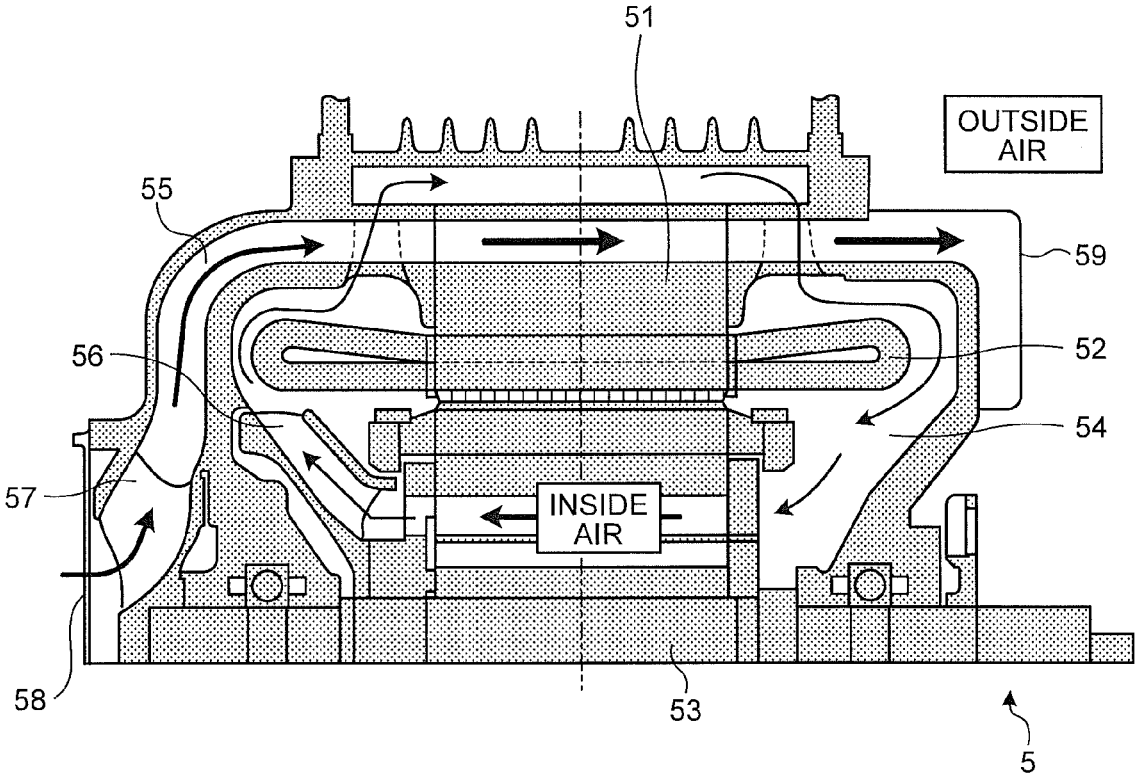
FIG. 4 is a cross-sectional view illustrating an exemplary configuration of a totally enclosed main motor according to the first embodiment.

FIG. 4 is a cross-sectional view illustrating an exemplary configuration of the totally enclosed main motor 5. As essential constituent elements of the totally enclosed main motor 5; a stator 51, a stator winding 52 that is wound around the stator 51, and a rotor 53 are illustrated in FIG. 4 by the corresponding reference numerals. Moreover, as a cooling mechanism of the totally enclosed main motor 5, an inside air ventilating flue 54 inside which the sealed air in the main motor circulates and an outside air ventilating flue 55 through which the outside air drawn in from a suction inlet 58 flows and then leaves from an exhaust outlet 59 are disposed. In addition, in the inside air ventilating flue 54 is disposed an inner fan 56 that allows the inside air to circulate. Similarly, in the outside air ventilating flue 55 is disposed an outer fan 57 that allows the outside air to let in from the suction inlet 58.

Due to the operation of the totally enclosed main motor 5, heat is generated internally thereby causing a rise in the temperature of the air in the inside air ventilating flue 54. However, since the inside air having its temperature increased circulates in the inside air ventilating flue 54, heat is released to the outside via a radiating fin or the like. Moreover, since heat exchange occurs around the stator 51 across the wall surfaces of the inside air ventilating flue 54 and the outside air ventilating flue 55, heat is released to the outside along with the outside air flowing through the outside air ventilating flue 55. Furthermore, since there is no direct air exchange between the inside air ventilating flue 54 and the outside air ventilating flue 55, even containing dust in the outside air, the dust is prevented from entering into the inside of the main motor.

As illustrated in FIGS. 1 and 2, a ventilating duct 9 that is used to draw in the outside air is attached to the totally enclosed main motor 5. The ventilating duct 9 opens toward the outside of the vehicle at the side covers 8. More particularly, the ventilating duct 9 has two open ends, one open end being connected to the suction inlet 58 of the totally enclosed main motor 5 and the other open end being guided to an opening 10 that is formed on the side covers 8. The other open end of the ventilating duct 9 and the opening 10 are mutually connected in a matching manner. In this way, in the present embodiment, the opening 10 is formed on the side cover 8 that is disposed at one side of the vehicle and the ventilating duct 9 is disposed to connect the suction inlet 58 to the opening 10. This makes it possible to supply the air from the outside of the vehicle directly to the outside air ventilating flue 55. Meanwhile, the opening 10 is, for example, rectangular in shape.

In the totally enclosed main motor 5, the exhaust outlet 59 is placed on the side at which the chassis 2 is connected to the totally enclosed main motor 5 via the shaft 6; while the suction inlet 58 is placed on the opposite side of the side at which the chassis 2 is connected to the totally enclosed main motor 5 via the shaft 6. The ventilating duct 9 elongates from the totally enclosed main motor 5 along the running direction of the vehicle, then bends in a substantial right angle, and linearly elongates up to the opening 10 formed on one of the side covers 8. Particularly, the ventilating duct 9 is so disposed that it lies perpendicular with respect to the side cover 8 at the opening 10. Meanwhile, in FIG. 2, the flow of the outside air is illustrated by arrows. The air from the outside of the vehicle is supplied to the totally enclosed main motor 5 via the ventilating duct 9 and exhausted from the totally enclosed main motor 5 to the side at which the chassis 2 lies.

The connecting portion of the ventilating duct 9 with respect to the totally enclosed main motor 5 is, for example, a connecting portion 11 that has a bellows shape with retractility and flexibility. Even if the joint portion between the totally enclosed main motor 5 and the ventilating duct 9 is subjected to stress due to the vibrations or movement generated along with the running of the vehicle, the connecting portion 11 elongates or contracts, or flexibly deforms along the longitudinal direction of the vehicle and reduces the vibrations or movement in a flexible manner. Therefore, the connection reliability between the totally enclosed main motor 5 and the ventilating duct 9 is secured in a stable manner.

Meanwhile, it is desirable to dispose, for example, a dust collecting filter 17 at the opening 10 such that it becomes possible to collect the dust contained in the air that flows in the ventilating duct 9 from the outside of the side cover 8. Thus, the dust can be prevented from entering into the ventilating duct 9 and the outside air ventilating flue 55. The dust collecting filter 17 can be disposed at the opening 10 or at the open end of the ventilating duct 9.

Given below is the description with reference to FIGS. 1 to 4 of the behavior of the abovementioned configuration according to the present embodiment. Due to the operation of the totally enclosed main motor 5, heat is generated therein. The generated heat causes a rise in the temperature of the sealed air in the inside air ventilating flue 54. The movement of the inner fan 56 allows the air having its temperature raised to circulate in the inside air ventilating flue 54. Meanwhile, since the outside air ventilating flue 55 is communicated with the ventilating duct 9 and since one end of the ventilating duct 9 opens toward the outside of the vehicle at the opening 10, the air of a relatively low temperature is drawn in from the outside of the vehicle to the outside air ventilating flue 55 by the operation of the outer fan 57. The drawn-in air of a relatively low temperature then flows through the outside air ventilating flue 55. Subsequently, heat exchange occurs between the high temperature air circulating in the inside air ventilating flue 54 and the relatively low temperature air flowing through the outside air ventilating flue 55. As a result, heat is released to the outside.

Given below is the effect of the present embodiment. According to the present embodiment, since the ventilating duct 9 is disposed to connect the suction inlet 58 of the totally enclosed main motor 5 to the opening 10 that is provided on one of the side covers 8, the air of a relatively low temperature is constantly supplied from the outside of the vehicle to the outside air ventilating flue 55. That enables achieving enhancement in the cooling efficiency of the totally enclosed main motor 5.

Figure 8:
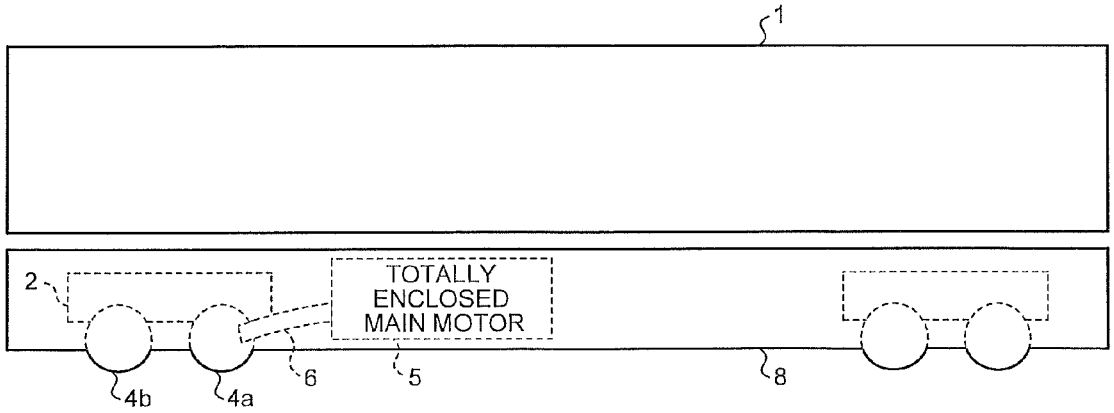
FIG. 8 is a schematic side view illustrating a configuration of a vehicle driving apparatus that does not include a ventilating duct.
Figure 9:
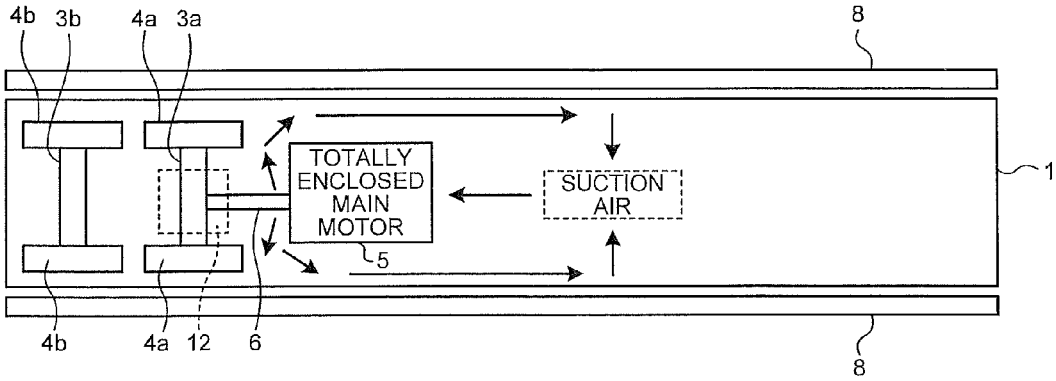
FIG. 9 is a schematic plan view illustrating the configuration of the vehicle driving apparatus illustrated in FIG. 8 when the bottom part of the corresponding vehicle is viewed from below.

Given below is the description with reference to FIGS. 8 and 9 about a case when the ventilating duct 9 is not disposed. FIG. 8 is a schematic side view illustrating a configuration of a vehicle driving apparatus that does not include a ventilating duct. FIG. 9 is a schematic plan view illustrating the configuration of the vehicle driving apparatus illustrated in FIG. 8 when the bottom part of the corresponding vehicle is viewed from below. Herein, the constituent elements identical to those illustrated in FIGS. 1 and 2 are referred to by the same reference numerals.

With reference to FIGS. 8 and 9, the totally enclosed main motor 5 draws in the outside air around the installation location from the suction inlet 58 and then exhausts high temperature air having a higher temperature than the temperature at the time of drawing in the outside air. Since the side covers 8 are disposed at the underfloor sides of the vehicle body 1, the high temperature air expelled by the totally enclosed main motor 5 tends to stagnate in the region surrounded by the side covers 8. Because of this, the totally enclosed main motor 5 happens to draw in the high temperature air from around the installation location and guide the drawn-in air in the outside air ventilating flue 55. As the totally enclosed main motor 5 carries on with the operation, the difference in the temperature of the air flowing through the outside air ventilating flue 55 and the temperature of the air circulating in the inside air ventilating flue 54 becomes gradually smaller. This causes substantial degradation in the cooling efficiency of the electric motor. In comparison, in the present embodiment, the outside air from the outside of the vehicle is reliably supplied via the ventilating duct 9 as the cooling wind that is not affected by the exhaust heat from the totally enclosed main motor 5. This enables achieving a high cooling efficiency.

Moreover, in the present embodiment, by drawing in the air with the operation of the outer fan 57, the cooling wind from the outside of the vehicle is supplied to the totally enclosed main motor 5 via the ventilating duct 9. That is, the outside air is drawn in by effectively utilizing the already-established features of the totally enclosed main motor 5. This eliminates the need of newly disposing a device for producing a forced ventilation. Furthermore, for example, a vehicle heat transfer apparatus disclosed in Patent Literature 2 utilizes the vehicle running wind generated when the vehicle is running as the cooling wind. In contrast, in the present embodiment, the air can be drawn in by using the outer fan 57 even if it is not possible to obtain sufficient vehicle running wind when the vehicle slows down or when the main motor is operating after the vehicle comes to a halt. Thus, it becomes possible to maintain a high cooling efficiency. Meanwhile, the object of Patent Literature 2 is to perform cooling of an electric equipment such as a transformer or a reactor. This object is different from the object of the present embodiment, which is to perform cooling of a totally enclosed main motor.

In the present embodiment, the suction inlet 58 and the exhaust outlet 59 provided on the totally enclosed main motor 5 are sufficiently spaced apart. More particularly, the exhaust outlet 59 is placed on the side at which the chassis 2 is connected to the totally enclosed main motor 5; while the suction inlet 58 is placed on the opposite side of the side at which the chassis 2 is connected to the totally enclosed main motor 5. Since the inlet side and the exhaust side are sufficiently spaced apart, the inlet side is not easily affected by the heat of the exhaust air. That contributes in enhancing the cooling efficiency. Moreover, such an arrangement also facilitates easy installation of the ventilating duct 9.

In the present embodiment, the ventilating duct 9 lies perpendicular with respect to the side covers 8 at the opening 10. Consequently, the air entering into the ventilating duct 9 from the opening 10 flows perpendicular with respect to the side covers 8. Such a configuration is feasible because of the abovementioned feature of drawing in the cooling wind without having to use the vehicle running wind. Thus, unlike in the case of having to use the vehicle running wind, there is no need to dispose the ventilating duct 9 at a slant with respect to the side cover 8. This makes the configuration simpler and installation easier. Moreover, the length of the ventilating duct 9 also decreases thereby enabling achieving cost reduction. However, identical to the conventional configuration, it is of course possible to dispose the ventilating duct 9 at a slant with respect to the side covers 8.

Since the dust collecting filter 17 is disposed at the opening 10, the dust contained in the air from the outside of the vehicle is prevented from entering into the ventilating duct 9. Consequently, the outside air ventilating flue 55 is also saved from the problem of the dust entering therein. This makes it easier to perform maintenance of the totally enclosed main motor 5.

Moreover, since the connecting portion 11 provided between the suction inlet 58 and the ventilating duct 9 has retractility and flexibility, it is possible to absorb the vibrations or movement generated along with the running of the vehicle. That enhances the connection reliability between the totally enclosed main motor 5 and the ventilating duct 9.

Furthermore, according to the present embodiment, the totally enclosed main motor 5 is disposed outside the frame of the chassis 2. This eliminates the dimensional constraints regulated by the chassis 2 while installing the totally enclosed main motor 5. Thus, it is possible to dispose the totally enclosed main motor 5 of a high capacity. That is, by loading the totally enclosed main motor 5 to the vehicle body portion other than the chassis 2, it becomes possible to secure sufficient space and thus increase the capacity of the totally enclosed main motor 5.

Figure 10:
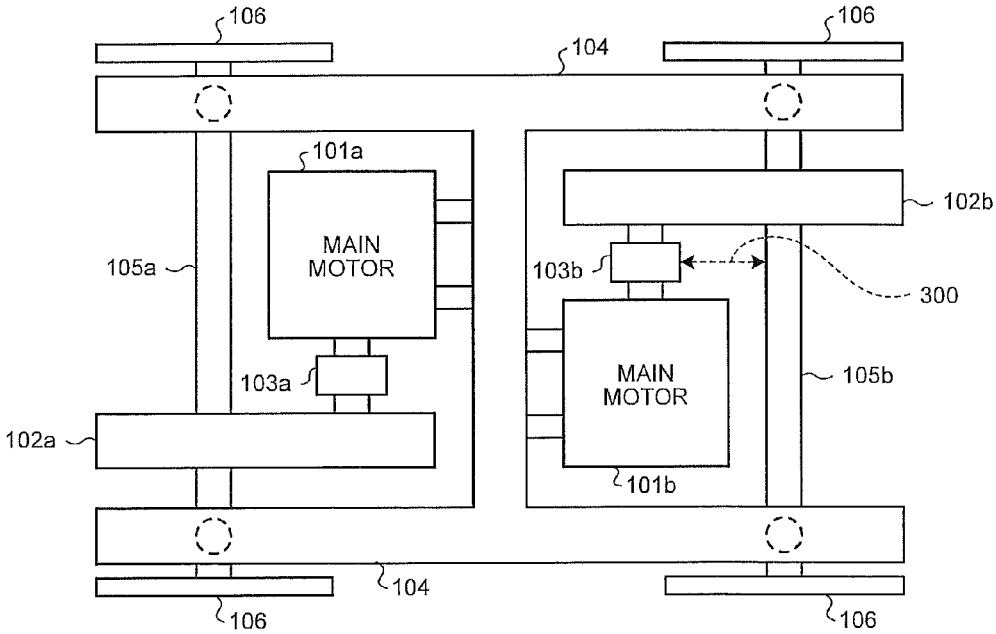
FIG. 10 is a plan view illustrating a configuration of a conventional vehicle driving apparatus.

Given below is the description with reference to FIG. 10 of an exemplary configuration in which main motors are disposed on a chassis. FIG. 10 is a plan view illustrating a configuration of a conventional vehicle driving apparatus. In FIG. 10, main motors 101*a* and 101*b* are disposed in a diagonal manner on a chassis frame 104. On the chassis frame 104 are disposed axles 105*a* and 105*b*. A wheel 106 is impactedly fixed to both ends of each of the axles 105*a* and 105*b*. A gear device 102*a* is connected to the axle 105*a*, while a gear device 102*b* is connected to the axle 105*b*. The rotating shaft of the main motor 101*a* and the pinion shaft of the gear device 102*a* are flexibly coupled by a gear-type flexible coupling 103*a*. Similarly, the rotating shaft of the main motor 101*b* and the pinion shaft of the gear device 102*b* are flexibly coupled by a gear-type flexible coupling 103*b*. The rotating shafts of the main motors 101*a* and 101*b* lie parallel to the axles 105*a* and 105*b*.

In such a conventional vehicle driving apparatus, it can be seen that the dimensions of the main motors 101*a* and 101*b* are constrained by the chassis frame. That is, it can be seen that the dimensional constraints by the rail width and the constraints by a distance 300 between the axle and the gear pinion (center distance) make it difficult to dispose main motors of a high capacity.

In the present embodiment, if the totally enclosed main motor 5 were to be, for example, an induction motor; then it was found that the capacity of the totally enclosed main motor 5 can be enhanced up to about twice the conventional capacity. Thus, unlike the example in FIG. 10 in which two main motors 101*a* and 101*b* are disposed with respect to the same chassis frame 104; a single totally enclosed main motor 5 is disposed with respect to a single chassis 2. This enables achieving substantial enhancement in the cooling efficiency while maintaining the running performance as before.

Since the totally enclosed main motor 5 is disposed outside the frame of the chassis 2, the shaft 6 is disposed to connect the totally enclosed main motor 5 to the axle 3*a*. In addition to its primary function of transmitting the rotary drive force of the totally enclosed main motor 5 to the axle 3*a*, the shaft 6 has good heat conductivity because of its metallic material. Thus, by helping the heat to release from the totally enclosed main motor 5, the shaft 6 contributes to the cooling effect. This enables achieving enhancement in the cooling efficiency of the totally enclosed main motor 5.

As described above, according to the present embodiment, in addition to achieving less maintenance and low noise, it is possible to provide a vehicle driving apparatus that includes the totally enclosed main motor 5 having a high capacity and enhanced cooling efficiency.

Second Embodiment

Figure 5:
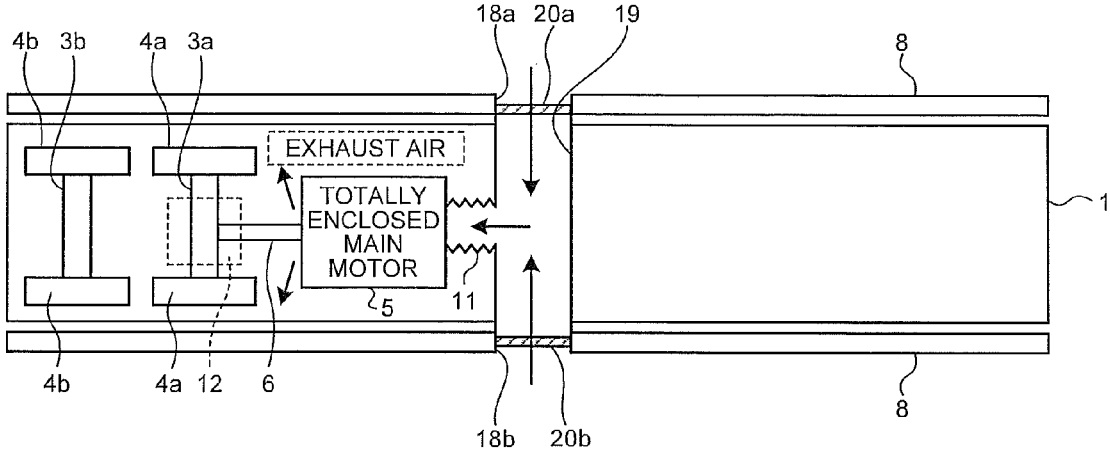
FIG. 5 is a schematic plan view illustrating a configuration of the vehicle driving apparatus according to a second embodiment when the bottom part of the corresponding vehicle is viewed from below.

FIG. 5 is a schematic plan view illustrating a configuration of the vehicle driving apparatus according to the present embodiment when the bottom part of the corresponding vehicle is viewed from below. In the present embodiment, the structure of a ventilating duct 19 is different from the structure of the ventilating duct 9 in the first embodiment. Meanwhile, in FIG. 5, the constituent elements identical to those illustrated in FIG. 2 are referred to by the same reference numerals and the detailed description thereof is omitted.

As illustrated in FIG. 5, the ventilating duct 19 is a T-shaped duct having three open ends. One of the three open ends is connected to the suction inlet 58 of the totally enclosed main motor 5. One of the remaining two open ends is connected to an opening 18*a* that is formed on the side covers 8 disposed at one side of the vehicle, while the other of the remaining two open ends is connected to an opening 18*b* that is formed on the side covers 8 disposed at the other side of the vehicle. In this way, in the present embodiment, the openings 18*a* and 18*b* are formed on the side covers 8 that are disposed at the mutually opposite sides. Moreover, a dust collecting filter 20*a* is disposed at the opening 18*a* and a dust collecting filter 20*b* is disposed at the opening 18*b*.

According to the present embodiment, for example, even if the opening 18*a* formed on one of the side covers 8 gets clogged due to foreign particles, it is possible to use the other opening 18*b* to draw in the air from the outside of the vehicle. Thus, it becomes possible to obtain a stable flow of the cooling wind through the ventilating duct 19. Meanwhile, although two openings are formed on the side covers according to the present embodiment, the number of openings is not limited to two and it is generally possible to form more than two openings. Apart from the above description, the configuration, the behavior, and the effect of the present embodiment are identical to that of the first embodiment.

Third Embodiment

Figure 6:
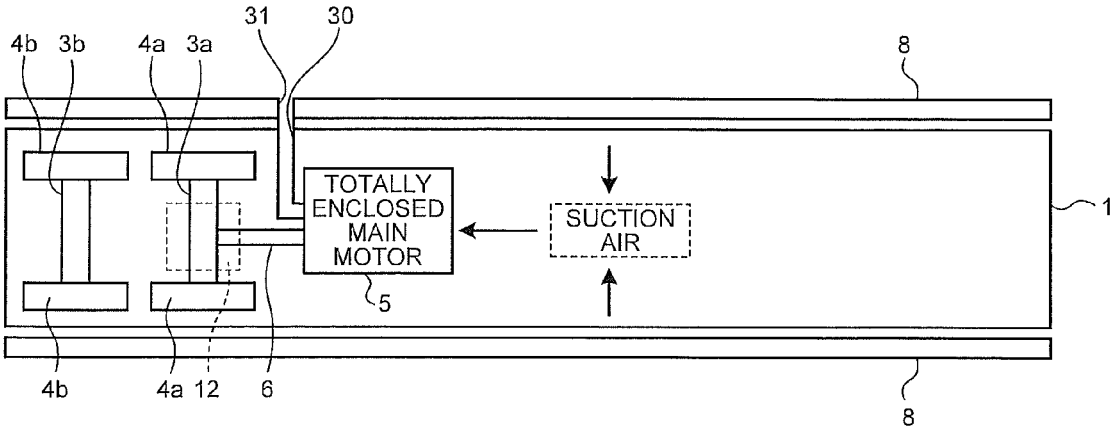
FIG. 6 is a schematic plan view illustrating an exemplary modification of the configuration of the vehicle driving apparatus according to a third embodiment when the bottom part of the corresponding vehicle is viewed from below.
Figure 7:
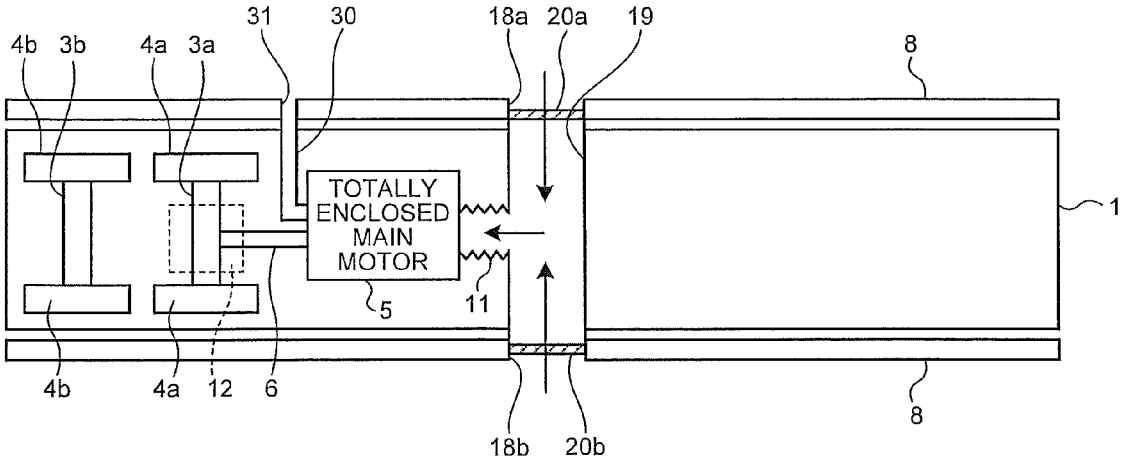
FIG. 7 is a schematic plan view illustrating a configuration of the vehicle driving apparatus according to the third embodiment when the bottom part of the corresponding vehicle is viewed from below.

FIG. 7 is a schematic plan view illustrating a configuration of the vehicle driving apparatus according to the present embodiment when the bottom part of the corresponding vehicle is viewed from below. FIG. 6 is a schematic plan view illustrating an exemplary modification of the configuration of the vehicle driving apparatus according to the present embodiment when the bottom part of the corresponding vehicle is viewed from below. Meanwhile, in FIGS. 6 and 7, the constituent elements identical to those illustrated in FIG. 2 are referred to by the same reference numerals and the detailed description thereof is omitted.

As illustrated in FIG. 7, in the present embodiment, a ventilating duct 30 for exhaust air is disposed in the configuration according to the second embodiment illustrated in FIG. 5. More particularly, one end of the ventilating duct 30 is connected to the exhaust outlet 59 of the totally enclosed main motor 5 and the other end of the ventilating duct 30 is connected to an opening 31 formed on the side covers 8.

Because of the ventilating duct 30 for exhaust air, the high temperature air exhausted from the outside air ventilating flue 55 of the totally enclosed main motor 5 can be reliable exhausted to the outside of the vehicle. That is, the air having its temperature increased due to the release of heat in the totally enclosed main motor 5 does not stagnate around the totally enclosed main motor 5. This enables achieving further enhancement in the cooling efficiency.

Moreover, in the totally enclosed main motor 5, the suction inlet 58 and the exhaust outlet 59 are sufficiently spaced apart. Particularly, the exhaust outlet 59 is placed on the side of the chassis 2 to which the totally enclosed main motor 5 is connected, while the suction inlet 58 is placed on the opposite side of the chassis 2 to which the totally enclosed main motor 5 is connected. The ventilating duct 30 for exhaust air is connected to the exhaust outlet 59. The ventilating duct 30 elongates along the connecting direction, then bends in a right angle with respect to the running direction of the vehicle, and connects to the opening 31 formed on the side covers 8. Therefore, the position of the opening 31 used in exhaust air is sufficiently spaced apart from the positions of the openings 18*a* and 18*b* used in suction air. Thus, the inlet side is not easily affected by the heat of the exhaust air.

Meanwhile, the exhaust air via the ventilating duct 30 is performed by the operation of the outer fan 57 that is disposed in the outside air ventilating flue 55 of the totally enclosed main motor 5. This eliminates the need of newly disposing a device for producing a forced blast. Moreover, there is also no need of using the vehicle running wind as is the case in the conventional technology.

The shape of the ventilating duct 30 for exhaust air is not limited to the shape according to the present embodiment and can be configured in, for example, T shape that is identical to the ventilating duct 19 used in suction air. Moreover, the connecting portion of the ventilating duct 30 with respect to the totally enclosed main motor 5 can be configured to have retractility and flexibility in an identical manner to the connecting portion 11. Apart from the above description, the configuration, the behavior, and the effect of the present embodiment are identical to that of the second embodiment.

Given below is the description with reference to FIG. 6 of an exemplary modification of the present embodiment. As illustrated in FIG. 6, in the present modification, the ventilating duct 19 used in suction air is removed from the configuration illustrated in FIG. 7. That is, regarding suction air, the air surrounding the suction inlet 58 is utilized. Then, by discharging the high temperature air that has been exhausted from the exhaust outlet 59 to the outside of the vehicle in a reliable manner, the rise in temperature around the suction inlet 58 is curbed as a measure to enhance cooling efficiency of the totally enclosed main motor 5. Thus, the third embodiment has a combined effect of the second embodiment and the present modification.

INDUSTRIAL APPLICABILITY

In this way, the present invention is suitable in a high-speed vehicle in which side covers are disposed at the sides of the bottom part of the vehicle.

The invention claimed is:

1. A vehicle driving apparatus that is disposed in a vehicle having a side cover at an underfloor side of a vehicle body and that runs the vehicle, with an electric motor as a power source, by rotatively driving an axle disposed on a chassis of the vehicle and a wheel fixed to the axle, the vehicle driving apparatus comprising:

a totally enclosed electric motor that is disposed outside a frame of the chassis placed under a floor of the vehicle body, that includes an outside air ventilating flue through which outside air is suctioned from a suction inlet, circulated and exhausted from an exhaust outlet, and that uses the outside air ventilating flue to release heat generated internally to outside;

a shaft that transmits a rotary drive force of the totally enclosed electric motor to the axle; and a ventilating duct that connects between the suction inlet and an opening formed on the side cover.

2. The vehicle driving apparatus according to claim 1, wherein the suction inlet of the totally enclosed electric motor is disposed on an opposite side of the chassis to which the totally enclosed electric motor is connected, and the exhaust outlet of the totally enclosed electric motor is disposed on a side of the chassis to which the totally enclosed electric motor is connected.

3. The vehicle driving apparatus according to claim 2, wherein, the ventilating duct is disposed so as to be perpendicular to the side cover at the opening.

4. The vehicle driving apparatus according to claim 3, wherein the ventilating duct has T shape with a first open end, a second open end, and a third open end, the first open end being connected to the suction inlet, the second open end being connected to an opening formed on the side cover disposed at one side of the vehicle, and the third open end being connected to an opening formed on the side cover disposed at the other side opposite to the one side of the vehicle.

5. The vehicle driving apparatus according to claim 4, wherein a dust collecting filter is provided at the opening.

6. The vehicle driving apparatus according to claim 3, wherein a dust collecting filter is provided at the opening.

7. The vehicle driving apparatus according to claim 2, wherein a dust collecting filter is provided at the opening.

8. The vehicle driving apparatus according to claim 1, wherein a dust collecting filter is provided at the opening.

9. The vehicle driving apparatus according to claim 1, wherein the suction inlet is placed on an opposite side of a side at which the chassis is connected to the totally enclosed electric motor.

10. The vehicle driving apparatus according to claim 1, further comprising:

a connecting portion that has retractility and flexibility and is connected to the suction inlet so that a retracting direction of the connecting portion is identical to a longitudinal direction of the shaft viewed from the underfloor side of the vehicle body, wherein the ventilating duct connects between the suction inlet and the opening formed on the side cover through the connecting portion.

* * * * *